US005665191A

United States Patent [19]

Johansson et al.

[11] Patent Number: 5,665,191

[45] Date of Patent: Sep. 9, 1997

[54] METHOD AND A DEVICE FOR CREATING IN A WEB OF SHEET MATERIAL A FOLD WHICH INCLUDES AT LEAST ONE ELASTIC THREAD

[75] Inventors: Dan Johansson, Västra Frölunda, Sweden; Leidulf Indrebø, Jersøy, Norway

[73] Assignee: SCA Mölnlycke AB, Göteborg, Sweden

[21] Appl. No.: 537,764

[22] PCT Filed: Apr. 21, 1994

[86] PCT No.: PCT/SE94/00355

§ 371 Date: Nov. 9, 1995

§ 102(e) Date: Nov. 9, 1995

[87] PCT Pub. No.: WO94/23681

PCT Pub. Date: Oct. 27, 1994

[30] Foreign Application Priority Data

Apr. 22, 1993 [SE] Sweden ..... 9301349

[51] Int. Cl.[6] ..... B31D 5/04; A61F 13/15

[52] U.S. Cl. ..... 156/161; 156/160; 156/199; 156/201; 156/204; 156/229; 156/461; 156/465; 156/494; 604/385.1; 604/385.2

[58] Field of Search ..... 156/229, 161, 156/160, 163, 164, 494, 495, 496, 461, 465, 204, 199, 201, 200; 604/385.1, 385.2

[56] References Cited

U.S. PATENT DOCUMENTS 2,490,451 12/1949 Magid ..... 156/161
4,704,116 11/1987 Enloe .
4,900,384 2/1990 Sanders et al. ..... 156/164 X
4,904,332 2/1990 McKeown ..... 156/164 X
5,190,606 3/1993 Merkatoris et al. ..... 156/164

FOREIGN PATENT DOCUMENTS

0411287A1 2/1991 European Pat. Off. .

*Primary Examiner*—Jeff H. Aftergut
*Attorney, Agent, or Firm*—Burns, Doane, Swecker & Mathis, L.L.P.

[57] ABSTRACT

The present invention relates to a method and to an arrangement for creating in a web (1) of sheet material a fold which includes at least one elastic thread (4). The web is placed on two mutually separated carrier elements (2, 3), and at least one prestretched elastic thread (4) is placed over the web in the space between the opposing edges of the carrier elements. The carrier elements are moved towards one another at the same time as the elastic thread or threads is/are moved down in the space between the carrier elements in abutment with the material web and in keeping with the rate at which the carrier elements are brought together, until at least one of the two opposing edges of the carrier elements, which approach one another as they are brought together, reaches the movement path of an elastic thread, wherein those parts of the web which abut one another when the carrier elements have been brought together to a mutually combined state are mutually joined along a line which extends transversely in relation to the direction in which the carrier elements are brought together.

10 Claims, 4 Drawing Sheets

METHOD AND A DEVICE FOR CREATING IN A WEB OF SHEET MATERIAL A FOLD WHICH INCLUDES AT LEAST ONE ELASTIC THREAD

The present invention relates to a method and to a device for creating in a web of sheet or layer material a fold which includes at least one elastic thread.

It is known to provide in those casing layers or sheets of diapers and like articles which lie proximal to the wearer in use longitudinally extending, sealed elastic-thread containing side folds, so as to form barriers which prevent liquid flowing on the upper surface of the casing sheet from reaching the side edges of the diaper. Examples of such barrier devices are disclosed in EP-B1 0,219,326 and U.S. Pat. No. 4,704,116. Diapers are now mass-produced at high-production rates, principly by placing absorbent bodies or pads on a moving web of sheet material and placing another moving web of sheet material on top of the first web carrying said absorbent bodies, whereafter the two layers of sheet material are joined together and the individual diapers are cut from the thus joined webs.

It has been found difficult in such manufacturing processes to provide folds of the aforesaid kind in the diaper casing sheets while maintaining a high rate of production at the same time.

The object of the present invention is to solve this problem and to provide a method and an arrangement by means of which a fold which contains at least one. elastic thread can be created in a web of material and which can be applied with known diaper manufacturing methods without causing interruptions in the manufacturing process and without needing to modify the manufacturing process, or at least to only a small extent.

This object is achieve in accordance with the invention with a method of the aforedescribed kind which is characterized by placing the web of material on two mutually spaced carrier elements; placing at least one pre-stretched elastic thread above the web in the space between the mutually spaced carrier elements; mutually combining the carrier elements while at the same time moving the elastic thread or threads down into the space between said carrier elements and in abutment with said web in keeping with the rate at which the carrier elements are brought together, until at least one of the two mutually opposing edges of the carrier elements which approach one another as the carrier elements are combined reaches the movement path of an elastic thread; and Joining together those parts of the web which abut one another in the mutually combined state of the carrier elements, at least along a line which extends transversely in relation to the direction in which the carrier elements are combined one with the other. This method can be integrated readily with known production processes in which a web of casing material is brought together, or combined, with another web of material intended for the remainder of the product, so as to form the final product, by superimposing a forward feeding movement on the movement which combines the carrier elements one with the other.

A device for carrying out the inventive method is characterized by two web-carrying elements which can be moved relative to one another between a position in which they are mutually separated and a position in which they are mutually combined; carrier element movement means; means for holding one or more elastic threads in a given position above the carrier elements and in the space defined therebetween in their mutually separated position; means for moving the elastic thread or threads down in the space between said carrier elements in keeping with the rate at which the carrier elements are moved towards one another; and means for joining mutually opposing parts of the web material in the combined state of the carrier elements, at least along a line which extends transversely in relation to the direction in which the carrier elements are brought to a mutually combined state.

In a preferred embodiment of the invention, the arrangement includes a rotatable wheel which carries a plurality of peripheral carrier elements which can be moved circumferentially in relation to one another with the aid of link mechanisms which are driven by the same drive means as that which rotates the wheel, through the medium of transmission means.

Exemplifying embodiments of a method and an arrangement according to the invention will now be described with reference to the accompanying drawings, in which FIGS. 1A–1D are cross-sectional views which illustrate schematically different steps of an inventive method for creating an elastic-thread containing fold in a web of sheet or layer material;

Figure 1B:
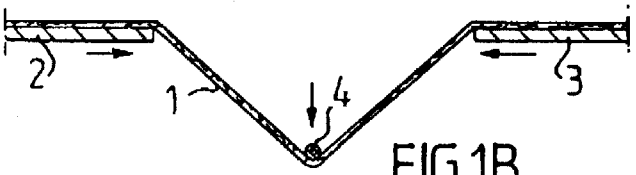
Figure 1D:
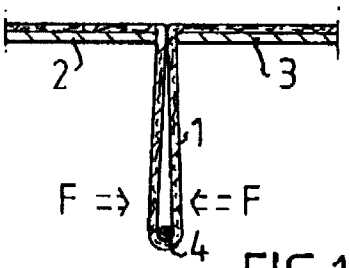
Figure 1A:
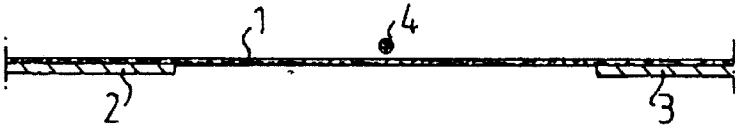
Figure 1C:
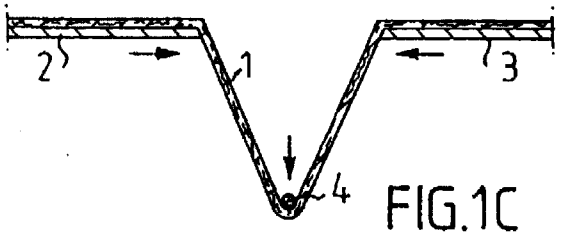
Figure 2B:
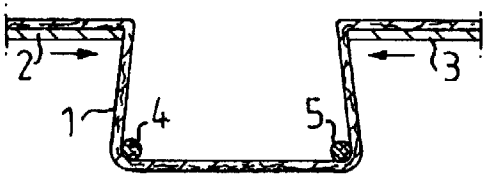
FIGS. 2A–2D are cross-sectional views which illustrate schematically different steps of an inventive method of creating two elastic-thread containing folds in a web of sheet or layer material.
Figure 2D:
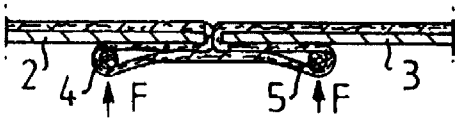
Figure 2A:
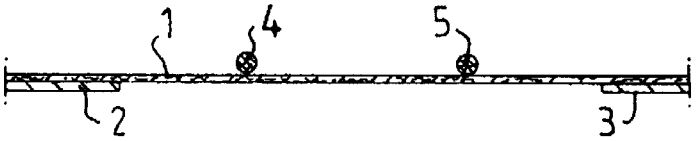
Figure 2C:
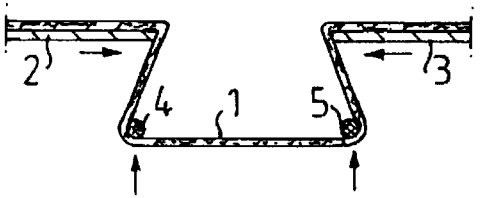

FIG. 1A shows a web 1 of sheet material, for instance non-woven material, placed on two carrier elements 2 and 3, which are spaced at a given distance apart and which extend over the full width of the web, i.e. the web extension in a direction perpendicular to the plane of the paper. A pre-stretched elastic thread 4 is held immediately above the web 1, in the space between the carrier elements 2, 3, and extends beyond the edges of the web 1. The carrier elements 2, 3 are movable towards and away from each other, and FIG. 1B shows the elements having been moved slightly towards each other. The elastic thread 4 has been moved downwards at the same time. In the FIG. 1C illustration, the carrier elements have come closer together and the elastic thread has been moved further downwards. These movements are indicated by arrows in the FIGS. In the FIG. 1D illustration, the carrier elements 2, 3 have been brought together and abut the intermediate parts of the web 1 at a given force. This abutment is utilized in joining these parts of the web together, so as to seal the fold at its base along the transverse edges of the carrier elements. This seal is achieved in some appropriate manner, for instance by gluing, ultrasonic-welding or heat-welding processes, depending upon the nature of the sheet material used. As shown in FIG. 1 by broken-line arrows, a force F is preferably applied at the transverse ends of the fold, so as to fasten there the ends of the elastic thread 4 to the mutually opposing parts of the fold. The thread 4 may also be fastened by gluing, ultrasonic-welding or heat-welding.

FIGS. 2A–2D illustrate in a manner similar to FIGS. 1A–1D the steps of creating two elastic-thread containing folds in accordance with one variant of the inventive method. Those components which are similar to the components of the FIGS. 1A–1D embodiment have been identified with like references.

The main difference between the method according to FIGS. 2A–2D and the method according to FIGS. 1A–1D, is that the elastic threads 4 and 5 are moved differently. Initially, there is no difference, and the threads 4 and 5 are moved downwards in keeping with the rate at which the carrier elements 2, 3 approach one another. As with the method according to FIGS. 1A–1D, this downward movement of the elastic threads continues until the edges of the carrier elements 2, 3 reach the vertical movement paths of the elastic threads 4 and 5 as the carrier elements are brought together, at which point in time downward movement of the elastic threads is interrupted. This point in time is illustrated in FIG. 1D, in which the edges of the carrier elements are shown to coincide with the downward movement path of the elastic thread with the carrier elements brought together and FIG. 2B, in which the edges of the carrier elements are shown separated from one another through a distance corresponding to the distance between the elastic threads 4 and 5. Starting from the position shown in FIG. 2B, it is, of course, possible to move the threads downwardly in mutually oblique movement, paths and obtain, in this way, a fold similar to the fold in FIG. 1D containing two elastic threads, although in this case it may be simpler to arrange the threads adjacent one another from the beginning. Instead, as indicated by arrows in FIG. 2C the threads are moved upwards and, as with the earlier described downward movement, in keeping with the rate at which the carrier elements are brought together. By "in keeping with the rate" is meant in the present application that the threads are moved at a speed at which essentially no stretch tensions will occur in the web as the fold is formed. With regard to the symmetrically placed threads in FIGS. 1A–2D, this means that those parts of the web 1 which are located between the edge of a carrier element 2, 3 and the nearest elastic thread 4, 5 shall move in a circular arc of constant radius in relation to said edge, thereby enabling the relationship between the sideways movement of the carrier elements and the downwards movement of the threads to be calculated with the aid of simple geometrical observations. On the other hand, the movement patterns become complicated when folds with limbs of different lengths are to be created, and consequently it is preferred to move the threads laterally preferably after vertical movement of the threads has been terminated or almost terminated. When one and the same fold is to contain several threads, the threads are preferably placed initially on top of one another with solely the lowermost thread abutting the web in the initial stage. For instance, if each of the two folds formed by the method illustrated in FIGS. 2A–2D is to contain two elastic threads, the second of these threads is placed on top of the corresponding fold-forming thread 4 or 5 and displaced laterally in relation thereto.

Thus, when practicing the inventive method, the elastic threads are used to control the formation of folds and to keep the web stretched as the folds are formed. This means that downward movement of the threads must be guided positively, i.e. the outer ends of the threads, said outer ends being supported by thread-holding means which are placed transversely slightly outside the longitudinally extending edges of the web, must be moved downwards in keeping with downward swinging of the web relative to the transverse edges of the carrier elements. Since the material webs for which application of the invention is primarily intended are very pliable and flexible, this downward movement of the threads can be guided positively also with slight tensioning of the threads. This positive guiding is not absolutely necessary in conjunction with the upward movement, for instance according to FIGS. 2C and 2D, because the extensibility of the elastic threads enables the web to entrain the threads upwards during the upward movement of the web forced by the bringing together of the carrier elements from the position shown in FIG. 2B to their mutually combined state illustrated in FIG. 2D. However, it is preferred to guide also the upward movement of the elastic threads in a manner to prevent substantially the occurrence of stretch tensions in the web, which would otherwise exert an obliquely upwards directed force on the elastic threads. Furthermore, the threads shall be fastened to the web, at least at both ends of a fold formed therein, which is facilitated, particularly when gluing said threads, when said ends are moved in the same movement pattern as adjacent parts of the web, in both the longitudinal and transversal directions.

It lies within the competence of one skilled in this art to provide for movement of the carrier elements and the elastic threads in many different ways , for instance with the aid of synchronously controlled hydraulic piston-cylinder devices and like devices. However, as previously mentioned, the invention is primarily intended for application on a moving web of material, in which the combining movements of the carrier elements shall be superimposed on a forward feed movement, and in which the drive means used to effect said forward feed is conveniently also used to move the carrier elements together and also to move the elastic threads. Devices in which the same drive means is used to produce a feeding movement and superimposed movements of carrier elements with the aid of link mechanisms and the like are well known to the art. U.S. Pat. No. 4,880,102, U.S. Pat. No. 4,394,899, GB-A 2,069,440 and GB-A 1,560,748, all teach arrangements of the kind whose principles can be applied to achieve movements which are superimposed on a forward feeding movement.

A preferred embodiment of an arrangement for creating elastic-thread containing folds in a moving web of material will now be described with reference to FIGS. 3 to 6.

Figure 3:
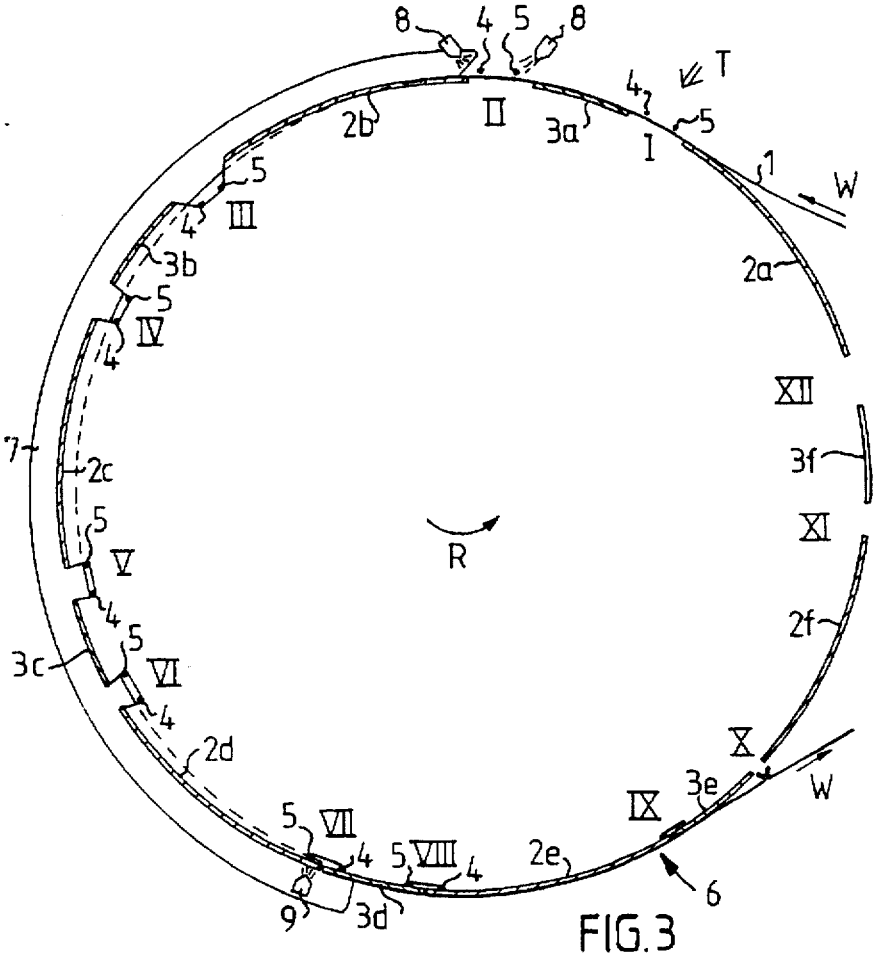
FIG. 3 is a schematic cross-sectional view of one embodiment of an device or arrangement for creating a row of mutually sequential elastic-thread containing folds in a moving web of material.

FIG. 3 is a schematic cross-sectional view of a rotating wheel 6 for forming folds in a moving web of material, the direction of movement of which web is shown by arrows W in the FIG., in accordance with the method described above with reference to FIGS. 2A–2D.

The wheel 6 rotates in an anti-clockwise direction, as indicated by the arrow R in FIG. 3, and supports peripheral, circular-arcuate carrier elements 2*a*–2*f*, 3*a*–3*f*. These carrier elements rotate together with the wheel 6 and also move towards and away from one another during one turn of the wheel, as a result of movement superimposed on the rotary movement by application of construction principles known from the earlier-mentioned documents U.S. Pat. No. 4,880,102, U.S. Pat. No. 4,394,899, GB-A 2,069,440 and GB-A 1,560,748.

The alternating carrier elements 2*a*–2*f* and 3*a*–3*f* extending mutually sequentially around the circumference of the wheel 6 are identical with one another and as they rotate will move in mutually the same way. The wheel 6 also carries mutually sequentially disposed elastic threads 4 and 5, which are applied in holder means (not shown in FIG. 3) in the space between respective carrier elements 2*a* and 3*a*, as indicated by the arrow T in the FIG. With the intention of enabling the invention to be understood more easily, there is also shown in FIG. 3 a stationary guide element 7 for the elastic threads 4, 5, said guide element being located outside that side edge of the actual wheel 6 which is distal in relation to the viewer of FIG. 3. A similar guide element and similar holding means are also placed outside the other side edge of the wheel 6.

Thus, as the wheel 6 rotates, the carrier elements 2*a* and 3*a* will successively take the positions of the carrier elements 2*b*–2*f* and 3*b*–3*f* respectively and the elastic threads will be moved in a radially-inwardly, radially-outwardly extending movement path by the guide elements 7, essentially in accord with the downward and upward movement path in FIGS. 2A–2D, in keeping with the rate of the carrier-element combining movement. In FIG. 3, the different positions of the centre points between the edges of the carrier elements are indicated by references I–XII. Because the same guide elements 7 are used for both threads 4, 5, the threads will take slightly different radial positions during a fold-forming process, as opposed to the ideal method illustrated in FIGS. 2A–2D, although these differences in the radial positions of the pairs of elastic threads 4, 5 is so small as not to have any significance on the final result, as will be seen from FIG. 3. The guide curve of the guide elements 7 will preferably be configured so as to compensate for these differences, meaning, for instance, that the elastic thread 4 located between the carrier elements 2*c* and 3*c* will be placed at a slightly greater distance from the edge of the carrier element 3*c* than would be the case if the threads were guided in the same manner as in FIG. 2B, in which the threads 4, 5 are located equidistant from the edge of respective carrier elements 2 and 3, so that the material web 1 is held constantly stretched.

The combining movement of the carrier elements 2*a*, 3*a* is not begun until the threads 4, 5 applied in the space between said elements at T during rotation of the wheel 6 have passed the position II. In this position, glue is sprayed through spray nozzles 8 onto the threads 4, 5 and also onto surrounding parts of the web 1 in the regions of its side edges. The threads 4, 5 then engage the guide elements 7 sequentially and are guided by said elements in a radially inwardly directed movement path in keeping with the rate at which the carrier elements are moved towards each other to the position V, in which those parts of the web located between the transverse edges of the carrier elements and nearest elastic thread have been swung through 90 degrees around respective edges. The threads are then guided radially outwardly until they reach abutment, in position VIII, with the undersurfaces of the carrier elements, or more specifically with parts of the web 1 folded in against the underside of said carrier elements. A glue nozzle 9 which applies a string of glue to those parts of the web 1 which are pressed against one another by the edges of the carrier elements at position VIII is mounted in position VII. The fold-forming process is thus terminated at position VIII. The web is then removed from the wheel 6. In order to enable removal of the web to be effected without the elastic threads needing to approach each other to and appreciable extent and therewith become stretched or tensioned above their prestretched state, the web is preferably not removed until reaching position X, at which the edges of the carrier elements have separated mutually to an extent such that the distance therebetween coincides essentially with the distance between the threads.

In order to hold the web 1 firmly on the carrier elements and therewith prevent the web from sliding in relation to the edges of said elements, the upper sides of the carrier elements are preferably covered with a friction-enhancing material. This will ensure that the same web length will always be located in the space between mutually adjacent carrier element edges.

Figure 4:
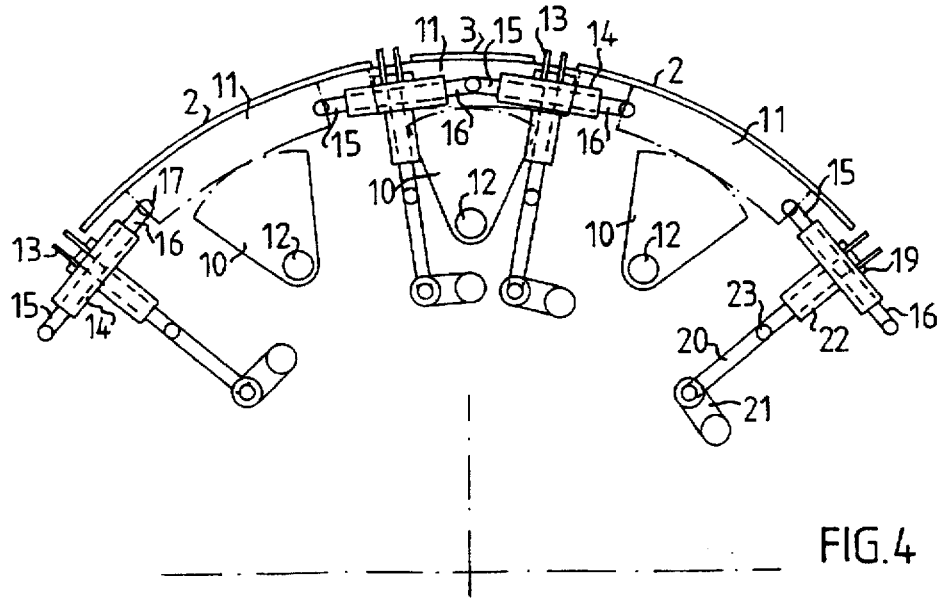
FIG. 4 is a schematic part view of the movement transmission mechanisms for coaction with different components of the arrangement illustrated in FIG. 3.
Figure 5:
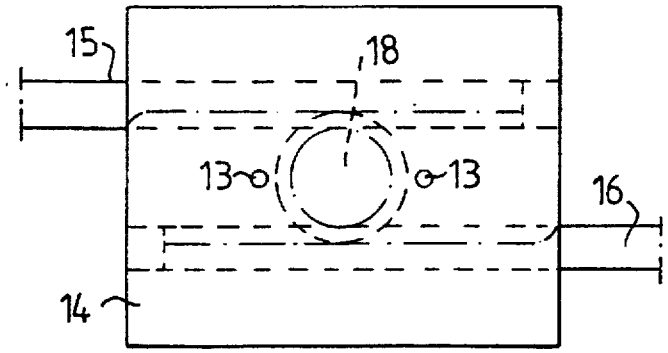
FIG. 5 is a view from above of a schematically illustrated elastic-thread holder element centering mechanism.

As illustrated schematically in FIG. 4, the mechanism of each carrier element 2, 3 operative in moving said elements towards and away from each other includes a toothed sector element 10 which meshes with a toothed ring section 11 attached to the underside of the carrier element. Each toothed sector element 10 is rotatably connected to a transverse shaft 12 which, in turn, is non-rotatably attached to the wheel 6 in a manner not shown, so as to accompany the wheel as it rotates. Thus, pivotal movement of the element 10 as a result of rotation of the shaft 12 will cause the carrier element to be moved in the circumferential direction of the wheel. Rotation of the shaft 12 as the wheel 6 rotates is preferably guided by a guide groove in which one end of a crankshaft or like device runs, the other end of said crankshaft being firmly connected to the shaft 12. The shaft 12 is preferably throughpassing and extends between two opposing tooth mechanisms 10, 11 mounted on opposite edge parts of each carrier element.

Also shown in FIG. 4 are elastic-thread holder elements in the form of upstanding pins 13 connected in pairs to a holder 14. The holder is shown from above in FIG. 5 and includes a toothed ring 18 which is journalled for rotation within the holder 14 and meshes with racks 15, 16. The racks 15, 16 are journalled in the housing with the aid of appropriate guide means so as to be movable parallel with one another, and each is connected with a carrier element via a hinged arm 17. The toothed mechanism included in the holder 14 ensures that the holder, and therewith the pins 13, will remain in the same position relative to the centre point between the transverse edges of the carrier elements irrespective of the movements performed by said edges as a result of rotation of the wheel 6.

Figure 6:
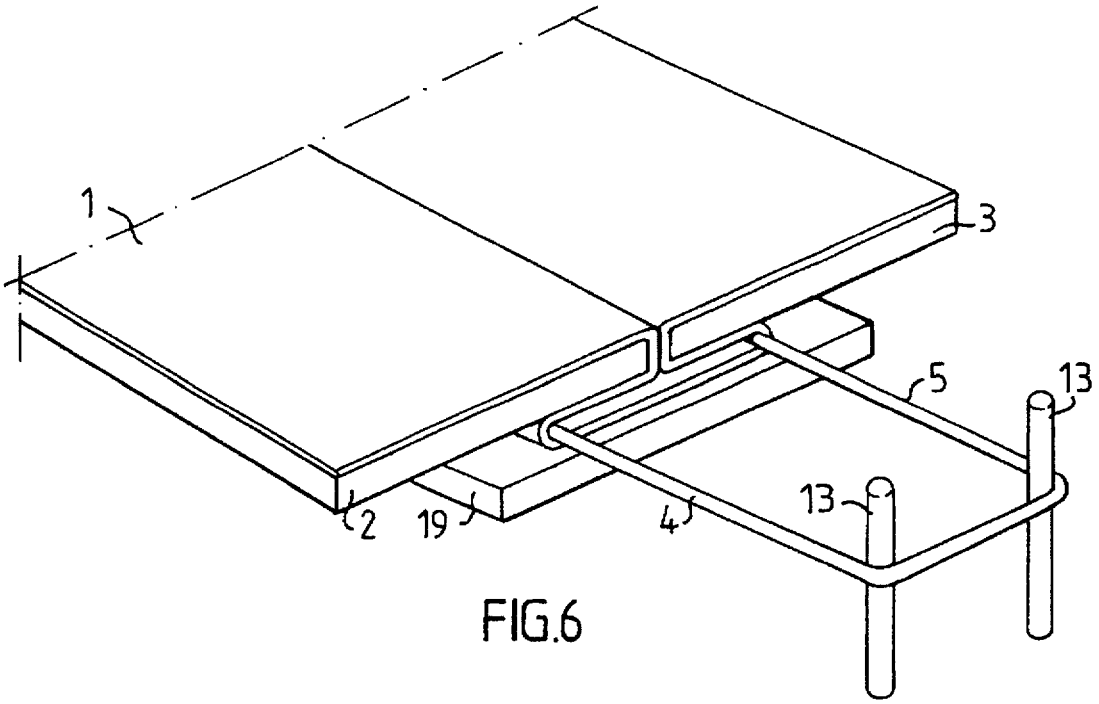
FIG. 6 is a perspective view of components of the arrangement illustrated in FIGS. 3–5.

As will be seen from the perspective view shown in FIG. 6, the elastic threads 4, 5 are comprised single thread placed over the holders 13, which means that the elastic threads can also be laid-out continuously above the web 1, i.e. radially outside as seen in the FIG., in conjunction with placing the web on the wheel 6. FIG. 6 also shows a pressure plate 19 which at the end of the fold-forming process (the position VIII in FIG. 3) lies against the folds, so that the ends of the threads 4, 5, i.e. those parts of the laid-out thread located in the edge regions of the folds, can be securely fastened to surrounding parts of the web 1. Thus, in the final stage of the fold-forming process, the pressure plate 19 shall be moved from a starting position in which it is located beneath, i.e. radially inwards of the lowest position of the threads (the position V in FIG. 3) upwardly from this position into abutment with the underside of the folds. This movement is also suitably guided by means of a link system controlled by a camming groove. As shown in FIG. 4, the pressure plate 19 is carried by a link rod 20 which is pivotally connected to a crankshaft 21 whose rotary movement is guided by a stationary camming groove (not shown). The pressure plate has a link system 20, 21 at each end, these link systems being mutually connected by a transverse rod 23. The up-and-down movement of the link rod 20 is also guided in a guide 22, which, in turn, suitably is connected to the holder 14, so that the pressure plate 19 will also be centered in relation to the centre line between the edges of the carrier plates.

According to one variant (not shown) of the illustrated embodiment of the fold-forming arrangement, the holders 13 are supported in extensions of the pressure plate 19 and the plate is guided in its camming groove so that the ends of the threads 4, 5 will follow the same path as that provided by the guide element 7 in the FIG. 3 embodiment. In the case of this variant, the threads 4, 5 must be laid-out very precisely, since those positions which the threads take as the wheel rotates, due to the up-and-down movement of the holders 13, are totally dependent on the vertical positioning of the threads on the holders when laying-out the threads. It is preferred to use guide elements 7 for this reason, so as to provide positive guiding of the threads without requiring high precision when laying-out said threads.

As will be understood, the illustrated embodiment of an arrangement for creating folds which include elastic threads can be modified within the scope of the present invention. For instance, the rotating wheel of the FIG. 3 embodiment can be replaced with a linearly moving conveyor path. Furthermore, movement of the components of the inventive arrangement can be achieved with the aid of mechanisms other than those described within the normal competence of one skilled in this art, and further threads maybe placed in the folds adjacent the threads 4, 5, these further threads being guided in the aforedescribed manner.

We claim:

1. A method for creating in a web of sheet material a fold which contains at least one elastic thread, characterized by placing the web on two mutually spaced carrier elements; placing at least one pre-stretched elastic thread above the web, in a space defined between mutually opposing edges of the carrier elements; moving the carrier elements towards each other while, simultaneously, moving the elastic thread or threads down in the space between said carrier elements in abutment with the web in keeping with a rate at which the carrier elements are brought together, until at least one of the two opposing edges of the carrier elements which approach each other as they are brought together reaches a movement path of an elastic thread; and mutually joining those parts of the web which lie against one another when the carrier elements have been brought to a mutually combined state, at least along a line which extends transversely in relation to a direction in which the carrier elements are brought together.

2. A method according to claim 1, characterized by joining ends of the elastic thread or the elastic threads to surrounding parts of the web in the mutually combined state of the carrier elements.

3. A method according to claim 1, characterized by placing two elastic threads at a same distance immediately above the web in the space between the mutually separated carrier elements.

4. A method according to claims 1, characterized by superimposing the movement which brings the carrier elements to their mutually combined state on a web-feeding movement.

5. A device for creating in a web of sheet material a fold which includes at least one elastic thread, characterized by two web-carrying elements which can be moved relative to one another between a mutually separated and a mutually combined position; carrier-element moving means; means for holding one or more elastic threads in a given position above the carrier elements and in a space defined therebetween in their mutually separated position; means for moving the elastic thread or threads down in the space between said carrier elements in keeping with a rate at which the carrier elements are moved towards each other; and means for joining together in the mutually combined state of the carrier elements mutually opposing parts of a web located in the space between said carrier elements, at least along a line which extends transversely relative to the direction in which the carrier elements are brought to their mutually combined state.

6. A device according to claim 5, characterized by means for moving the carrier elements in a continuous movement on which the movement of the carrier elements towards and away from each other is superimposed.

7. A device according to claim 6, characterized in that the arrangement includes a rotatable wheel which carries a plurality of peripheral carrier elements which can be moved circumferentially in relation to one another with the aid of link mechanisms which are intermediary transmission means are driven to rotate the wheel.

8. A device according to claim 7, characterized in that the elastic-thread holding means includes a holder which supports upstanding holder elements and accommodates a centering means which centres the holder relative to a center line of the space defined between mutually opposing edges of adjacent carrier elements.

9. A device according to claim 7, characterized in that the link mechanisms are guided by stationary camming grooves.

10. A device according to claim 5, characterized in that the means for moving the elastic threads in a radial inward and outward path is comprised of a guide curve on a stationary element placed between the holder elements and the peripheral edges of the carrier elements.

* * * * *